US007845694B1

(12) United States Patent
Lockwood

(10) Patent No.: US 7,845,694 B1
(45) Date of Patent: Dec. 7, 2010

(54) WASTE HANDLING AND BAGGING UNIT

(76) Inventor: Timothy Lockwood, P. O. Box 51256, Sparks, NV (US) 98435

( * ) Notice: Subject to any disclaimer, the term of this patent is extended or adjusted under 35 U.S.C. 154(b) by 347 days.

(21) Appl. No.: 12/069,391

(22) Filed: Feb. 11, 2008

(51) Int. Cl.
*A01K 29/00* (2006.01)
*A47L 13/18* (2006.01)

(52) U.S. Cl. ..... 294/1.3; 294/25; 15/227; 2/158

(58) Field of Classification Search ..... 294/1.3, 294/1.4, 1.5, 25, 131; 2/16, 20, 160, 161.6, 2/161.7, 158; 383/1, 4, 37; 15/227
See application file for complete search history.

(56) References Cited

U.S. PATENT DOCUMENTS 2,505,409 A * 4/1950 Kirchner ..... 15/227
2,736,052 A * 2/1956 Tufarolo ..... 15/227
4,069,913 A * 1/1978 Harrigan ..... 206/278
4,626,291 A 12/1986 Natale
4,645,251 A 2/1987 Jacobs
4,768,818 A 9/1988 Kolic
4,783,129 A 11/1988 Jacobson
4,788,733 A 12/1988 Lerner
4,964,188 A * 10/1990 Olson ..... 15/227
5,008,969 A * 4/1991 Jarrett ..... 15/227
5,400,572 A 3/1995 Peck et al.
5,438,708 A 8/1995 Jacovitz
5,806,099 A * 9/1998 Grinberg ..... 2/158
5,961,167 A 10/1999 Gilley
6,024,970 A * 2/2000 Woodard ..... 424/402
6,257,473 B1 7/2001 Ringelstetter
6,511,111 B2 1/2003 Dooley
7,080,863 B2 7/2006 Cappellano et al.

* cited by examiner

*Primary Examiner*—Dean J Kramer
(74) *Attorney, Agent, or Firm*—Albert O. Cota

(57) ABSTRACT

A waste handling and bagging unit (10) that is comprised of a mitt (12) having an upper layer (14), a lower layer (36) and a hand opening (64). Either a single bag (70) or a plurality of nested bags (70) encompass the mitt (12) and are attached to the mitt by at least one grommet assembly (112,128) that is located adjacent to the hand opening (64) on the mitt (12). The waste handling and bagging unit (10) allows a person to quickly, easily and hygienically grasp waste material, such as fecal matter from a pet, and then to enclose the waste material within one of the bags (70) for disposal. When a single bag (70) is utilized, a person will manually place a new bag on the mitt (12) for each instance of waste removal. The nested bags (70) allow a person to repeatably gasp and dispose multiple instances of waste material without having to manually put a new replacement bag (70) on the mitt (12).

21 Claims, 5 Drawing Sheets

WASTE HANDLING AND BAGGING UNIT

TECHNICAL FIELD

The invention typically pertains to waste handling gloves and mitts, and more particularly to a waste handling and bagging unit that is worn on a person's hand and that quickly, easily and hygienically allows waste material to be grasped and bagged for disposal.

BACKGROUND ART

One of the greatest pleasures in life for many people is owning a pet, such as a cat or a dog. For many people a pet is their primary companion, and many families consider a pet as a member of the family.

Pet ownership does have considerable responsibilities though. Some pets are more independent than others. Cats, for example, do not typically require regular walks and indoor cats are almost all trained to use a litter box. Dogs, on the other hand, especially dogs that reside indoors, must be taken for regular walks that provide exercise and the opportunity for the dog to relieve itself.

Unfortunately, some dog owners fail to remove their dog's waste material from where it is deposited. This has led to many cities, as well as private dwellings such as apartment/condo complexes, to impose a rule that all dog/pet waste must be picked up and disposed of by the animal's owner or caregiver.

The most common method for grasping and disposing of pet waste is a plastic bag. Although dedicated plastic bags for pet waste are available, most people simply use the common plastic bags that are used for groceries and other consumer products.

While these bags do function adequately well for pet waste removal, they are not very sanitary or often pleasant to use. One complaint is that recently left pet waste is significantly warm and the person holding the waste feels the heat. Also, a plastic bag does not provide much of a barrier between the pet waste and a person's skin. The chance of contact between the waste and skin is high, and the chance only increases if the bag has a tear in it. In addition to disgusting most people, there is also a significant chance of bacteria being transferred from the waste to a person.

Obviously, if there was a way by which a person could conveniently and hygienically grasp and dispose of waste material, the benefits would be substantial.

A search of the prior art did not disclose any patents that read directly on the claims of the instant invention, however the following U.S. patents are considered related:

| PATENT NO. | INVENTOR | ISSUED |
|---|---|---|
| 4,645,251 | Jacobs | 24 Feb. 1987 |
| 4,768,818 | Kolic | 6 Sep. 1988 |
| 5,438,708 | Jacovitz | 8 Aug. 1995 |

The U.S. Pat. No. 4,645,251 patent discloses a glove-like waste disposal system that comprises a relatively thick, heat-insulating, flexible inner glove which is placed over the hand of a user. An outer glove is then placed over the inner glove. Waste material is picked up by the user whose hand is contained within the inner glove. The outer glove is then peeled or stripped off to an inside-out pouch-forming configuration which contains the picked-up waste material therein. The outer glove with the waste material therein is disposed. The inner glove is reusable, and serves to insulate the user's hand from the temperature and "feel" of the waste material.

The U.S. Pat. No. 4,768,818 patent discloses a disposable mitt that is made of pliant material. The mitt is adapted to provide soil-protection for the hand while exposing a manipulable pocket for pickup of litter, such as dog litter. The mitt is adapted for reversal such that, once the litter is grasped via the pocket, the act of reversal closes the pocket while the hand maintains its grasp, to the point of fully enclosing the litter within the pocket before removing the hand. Remaining reversed mitt material may then be used in a circumferentially tensed wrapping of the loaded and closed pocket.

The U.S. Pat. No. 5,438,708 patent discloses a device for manually collecting, containing and disposing of waste material, such as animal excrement. The invention provides an ambidextrous glove having individual compartments for receiving the fingers and thumb of the hand. The glove has a sleeve portion with a pair of handles which are used to secure the sleeve portion on the forearm of the user. The handles are also used for turning the glove inside out to contain the collected material, and for sealing the device.

For background purposes and as indicative of the art to which the invention is related reference may be made to the remaining patents located in the search.

| PATENT NO. | INVENTOR | ISSUED |
|---|---|---|
| 7,080,863 | Cappellano et al | 25 Jul. 2006 |
| 6,511,111 | Dooley | 28 Jan. 2003 |
| 6,257,473 | Ringelstetter | 10 Jul. 2001 |
| 5,961,167 | Gilley | 5 Oct. 1999 |
| 5,400,572 | Peck et al | 28 Mar. 1995 |
| 4,788,733 | Lerner | 6 Dec. 1988 |
| 4,783,129 | Jacobson | 8 Nov. 1988 |
| 4,626,291 | Natale | 2 Dec. 1986 |

DISCLOSURE OF THE INVENTION

In its basic design, the waste handling and bagging unit is comprised of a mitt having an upper layer, a lower layer and a hand opening. A plurality of nested waste bags encompass the mitt and are attached to the mitt by a grommet assembly that is located adjacent the hand opening on the mitt.

The waste handling and bagging unit allows a person to quickly, easily and hygienically grasp waste material, such as fecal matter from a pet. The waste material is then enclosed within one of the bags for disposal. By utilizing the plurality of nested waste bags, a person can repeatably grasp and dispose multiple instances of waste material without having to manually put a new replacement bag on the mitt for each instance.

In view of the above disclosure, the primary object of the invention is to provide a waste handling and bagging unit that allows a person to quickly, easily and hygienically grasp, bag and dispose of waste material.

In addition to the primary object, it is also an object of the invention to provide a waste handling and bagging unit that:

- can be made in various sizes, such as small, medium and large,
- can be folded and carried in a bag,
- can be carried by hand, can be worn, or can be attached to an article of clothing,
- can be made in various colors,
- can be worn on either the left hand or the right hand, can be sold with or without replacement bags, can include indicia such as directions for use, a company name or other advertising, and can be easily and cost-effectively manufactured.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment with multiple design configurations, and a second embodiment, of a waste handling and bagging unit (hereinafter "WHBU 10").

The WHBU 10 which is shown in FIGS. 1-5, and is also known as the SHMITT™ is designed to facilitate the quick, easy and hygienic grasping and bagging of waste material. Typically, the waste material will consist of fecal matter from a pet, but the WHBU 10 can also be used to grasp and bag other types of waste material as well. The WHBU 10 is worn on a person's hand, or carried along and then placed on a hand, for any occasion that requires the grasping and bagging of waste material that a person chooses to remove or is responsible for removing. Once the waste material is grasped and bagged, it can then be easily disposed of.

Figure 1:
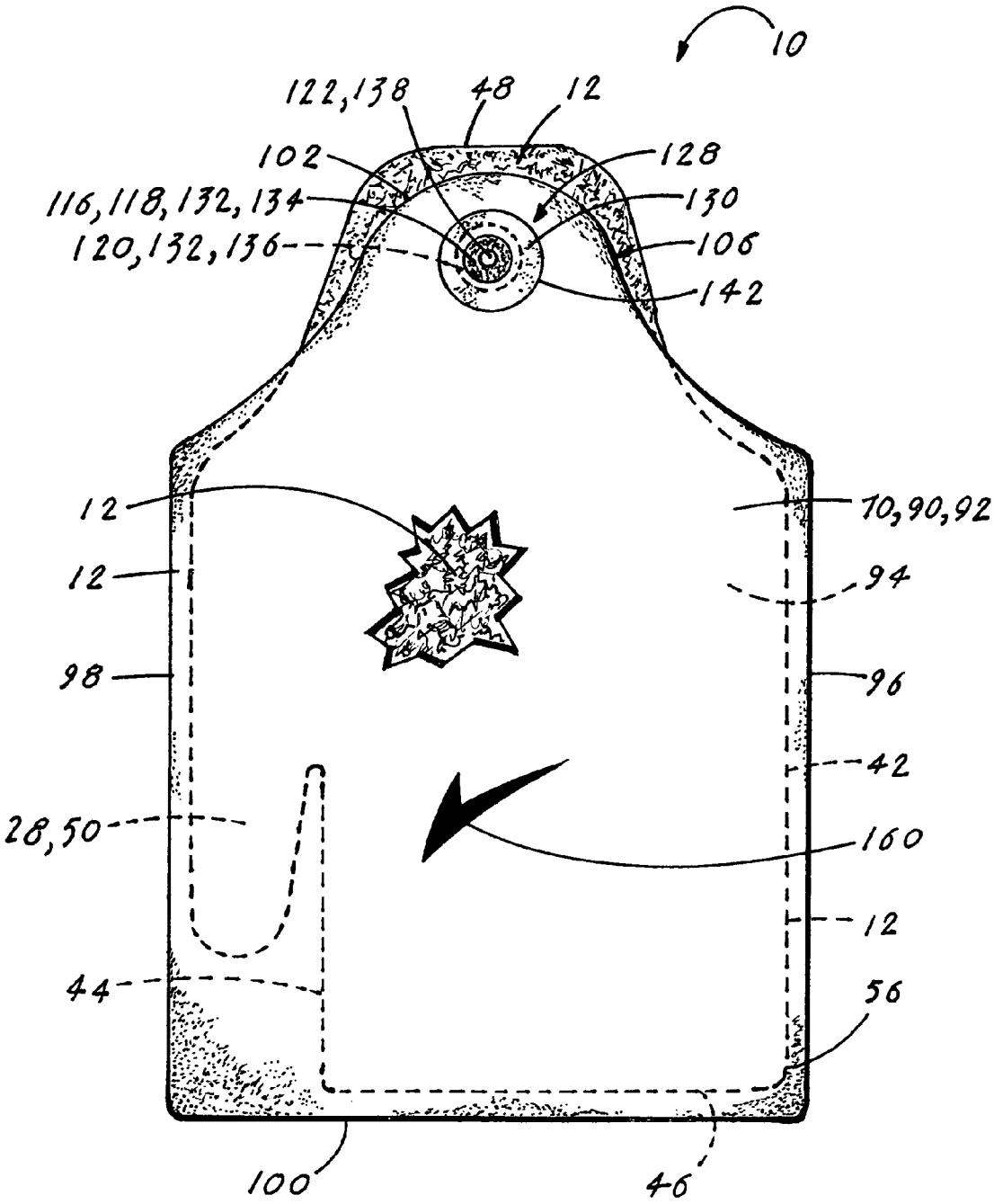
FIG. 1 is a lower elevational view of the preferred embodiment of a waste handling and bagging unit showing a plurality of nested bags inserted over a mitt.
Figure 2:
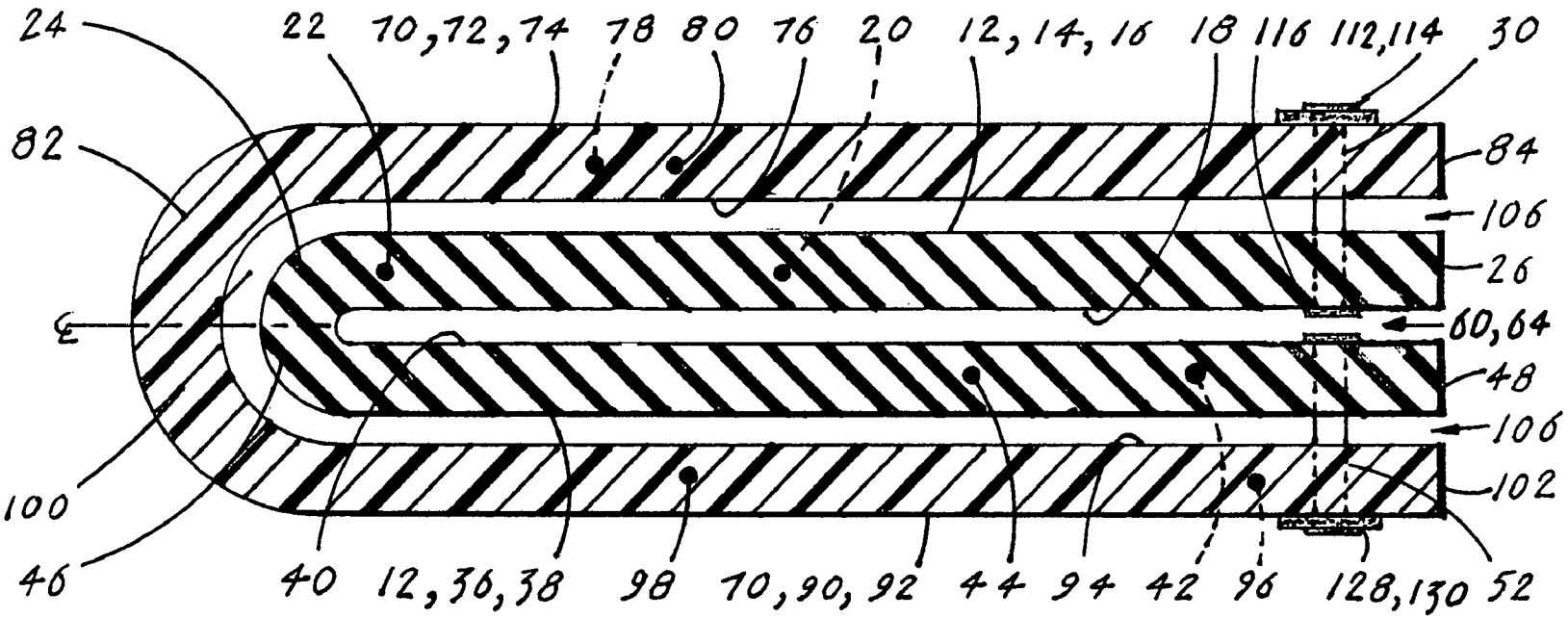
FIG. 2 is a cross-sectional side view of the waste handling and bagging unit. For clarity the plurality of bags is shown as a single element.
Figure 3:
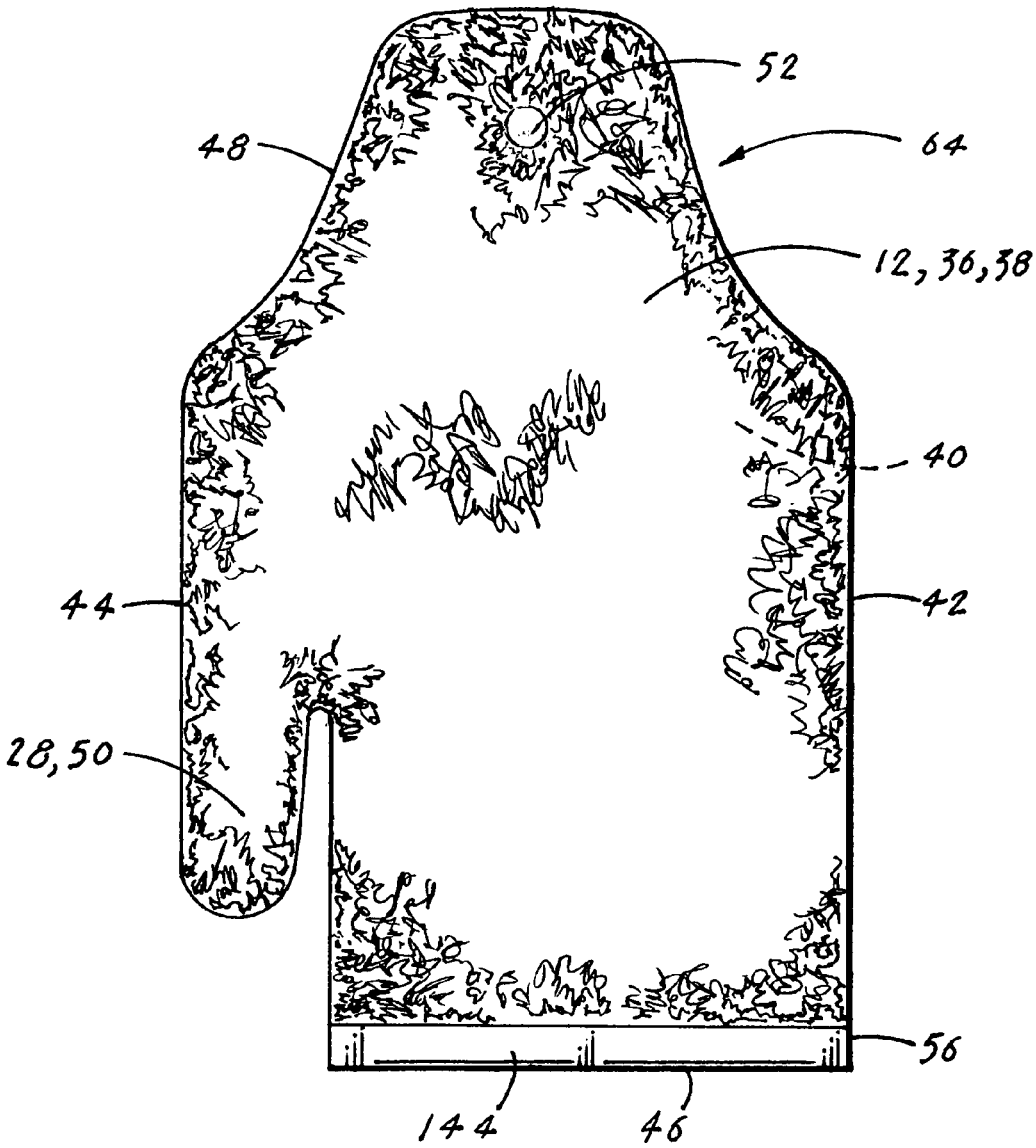
FIG. 3 is a lower elevational view showing a rigid member attached to the front edge of the mitt.
Figure 4:
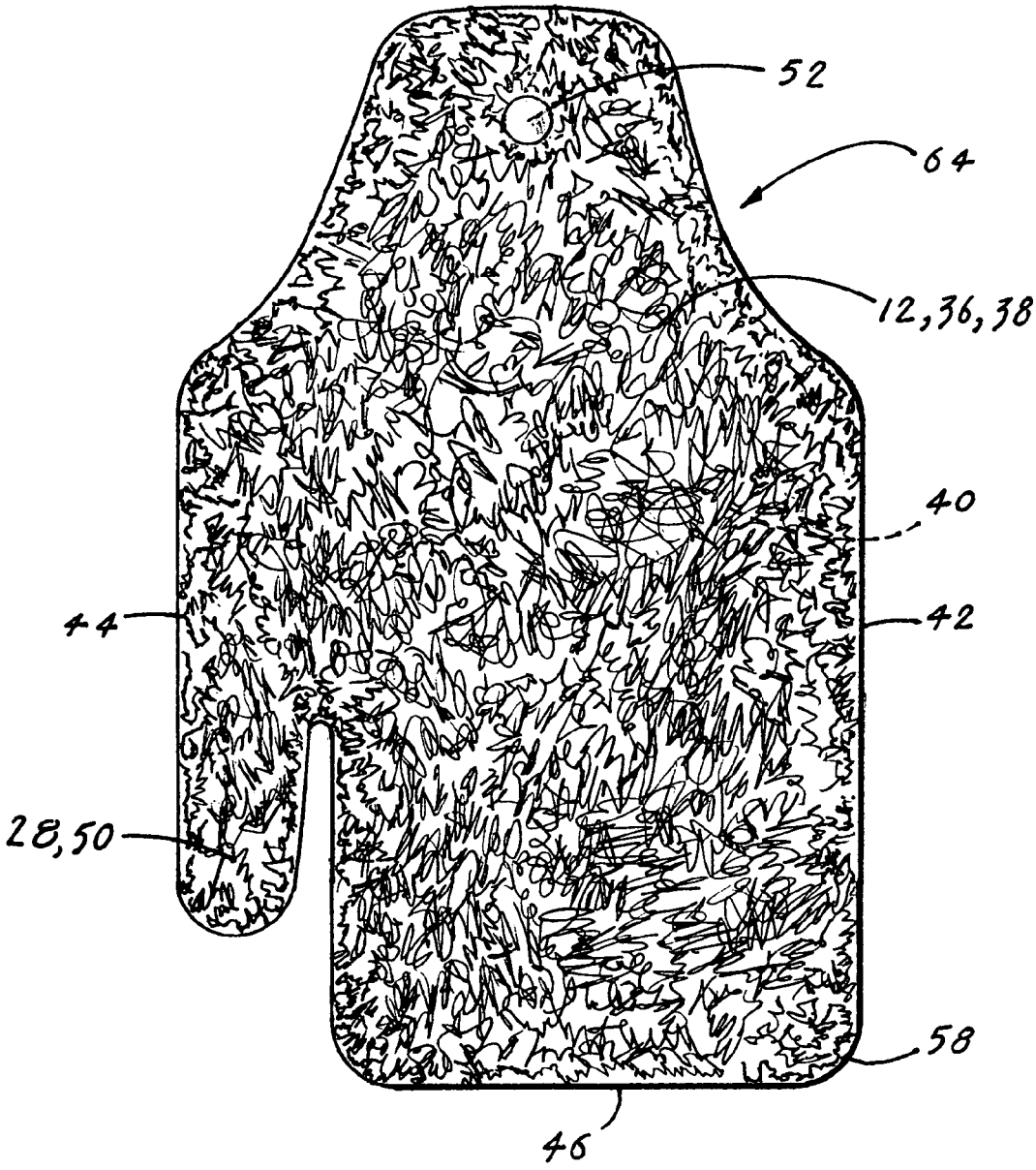
FIG. 4 is a lower elevational view showing a mitt with a rectangular front edge that has rounded corners.

The preferred embodiment of the WHBU 10 is comprised of a mitt 12 having a substantially rectangular shape 56, as shown in FIGS. 1, 2 and 3. In another design configuration the mitt 12 can have a substantially rectangular shape with rounded corners 58, as shown in FIG. 4. In both design configurations, the mitt 12 is comprised of an upper layer 14 with an outer surface 16, an inner surface 18, a right edge 20, a left edge 22, a front edge 24, a rear edge 26, a left or right thumb opening 28 and a grommet opening 30. The mitt 12 also has a lower layer 36, which is the palm side, with an outer surface 38, an inner surface 40, a right edge 42, a left edge 44, a front edge 46, a rear edge 48, a left or right thumb opening 50 and a grommet opening 52.

The upper layer 14 and the lower layer 36 of the mitt 12, as shown in FIGS. 1 and 2, are attached together by an attachment means 60 to form a complete, unitary mitt. The attachment means 60 are selected from the group consisting of an adhesive, heat pressing, stitching or stapling. Once the upper layer 14 and the lower layer 36 on the mitt 12 are attached together, a hand opening 64, as best shown in FIG. 2, is created.

Preferably, the mitt 12 is made of a biodegradable material such as foam, corn plastic, paper, cotton or closed-cell foam. The mitt 12 can also be made of a non-biodegradable material such as acrylic, PVC, polyester, rubber or nylon.

The WHBU 10 also comprises a plurality of nested waste bags 70. As shown in FIGS. 1 and 2, the nested waste bags 70 encompass the mitt 12. Each waste bag 70 has an upper layer 72 with an outer surface 74, an inner surface 76, a right edge 78, a left edge 80, a front edge 82 and a rear edge 84. Each bag 70 also has a lower layer 90 with an outer surface 92, an inner surface 94, a right edge 96, a left edge 98, a front edge 100 and a rear edge 102. During the bag manufacturing process, which is well know in the art, the corresponding edges of the upper layer 72 and the lower layer 90 are attached together, thereby creating the bag 70. It should be noted that the respective rear edges 84,102 are not attached together in order to create an opening 106, as best shown in FIG. 2, that corresponds to the hand opening 64 on the mitt 12. As with the mitt 12, each bag 70 has a grommet opening 108 and is preferably made of a biodegradable material, such as corn plastic, paper or cotton. The bag 70 can also be made of a non-biodegradable material such as polyethylene, acrylic, PVC, polyester or nylon.

Located on the upper layer 14 of the mitt 12 adjacent the rear edge 26, is an upper grommet assembly 112. The upper grommet assembly 112, as shown in FIG. 2, is comprised of an outer ring 114, an inner ring 116 having an outer member 118 and an inner member 120, and a bore 122. The bore 122 extends through the outer ring 114, the inner ring 116 and the mitt 12. Located on the lower layer 36 of the mitt 12 adjacent the rear edge 48 is a lower grommet assembly 128 that preferably corresponds in size and shape to the upper grommet assembly 112. The lower grommet assembly 128, as shown in FIGS. 1 and 2, is also comprised of an outer ring 130, an inner ring 132 having an outer member 134 and an inner member 136, and a bore 138 that extends through the preceding lower grommet assembly elements.

The bores 122,138 provide a convenient means of storing the WHBU 10 on a wall hook or attaching the WHBU 10 to an article of clothing, such as a belt, thus allowing the WHBU 10 to be easily carried when not in use.

Additionally, one or both of the grommet assemblies 112, 128 provides the means by which the plurality of nested waste bags 70 are maintained over the mitt 12. As shown in FIG. 1, the waste bags 70 are attached by an attachment means 142 to the mitt 12 around the upper grommet bore 122 and/or the lower grommet bore 138. The attachment means 142 are selected from the group consisting of sonic welding, heat pressing, an adhesive or stitching.

In the preferred embodiment, both grommet assemblies 112,128 are utilized, but in other design configurations, only an upper grommet assembly 112 or a lower grommet assembly 128 is utilized.

As previously disclosed, located at the rear edge of the mitt 12 is a hand opening 64, and located at the rear edge of each waste bag 70 is a corresponding opening 106. The two openings 64,106, as shown in FIG. 2, allow a person to insert their hand into the mitt 12, quickly and easily grasp waste material, and then to enclose the waste material within one of the bags 70 for disposal.

One of the most useful and novel aspects of the WHBU 10 is that by utilizing the plurality of nested waste bags 70, a person can repeatably grasp, bag and dispose of multiple instances of waste material without having to put a new replacement bag 70 on the mitt 12 for each instance. Once the waste material has been grasped, the person will simply pull the waste bag 70 off the mitt 12 while simultaneously retaining and enclosing the waste material within the bag 70. The bag 70 with waste material therein can then be disposed of, and the WHBU 10 is ready for use with a new bag.

As shown in FIG. 3, to add to the utility of the WHBU 10, a rigid member 144 is located across the front edge of the mitt 12. The rigid member 144 adds strength to the front edge, thereby allowing scooping or shoveling actions to be performed. This is especially helpful for waste material that is stuck to or otherwise difficult to remove from the surface upon which it is located.

Figure 5:
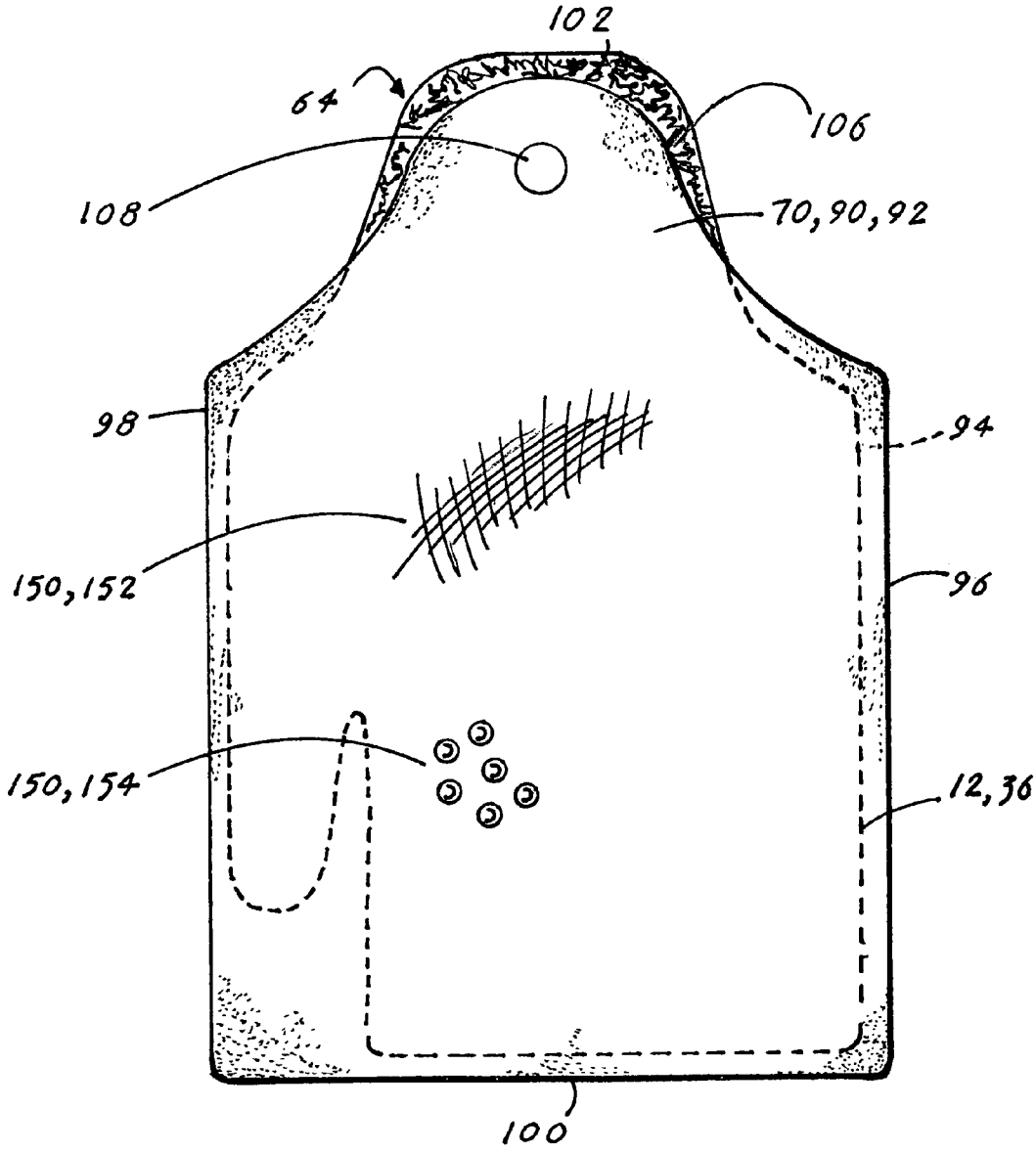
FIG. 5 is a front elevational view of the second embodiment of the waste handling and bagging unit showing a single bag inserted over a mitt and the bag having a textured surface consisting of calendering or a multiplicity of protrusions.

Additionally, as shown in FIG. 5, the lower layer 90 of each bag 70 can have a textured outer surface 150. The texturing can consist of calendering 152 or a multiplicity of protrusions 154 that provide improved grasping of the waste material.

If desired, the WHBU 10 can also include indicia 160, such as directions for use, a company name or advertising. The indicia 160, as shown in FIG. 1, would be located on the mitt's upper layer outer surface 16, the mitt's lower layer outer surface 38, each bag's upper layer outer surface 74 and/or each bag's lower layer outer surface 92.

The second embodiment of the WHBU 10, as shown in FIG. 5, is similar to the preferred embodiment except that only a single bag 70 is utilized at a time. The second embodiment of the WHBU 10 is also comprised of a mitt 12 having an upper layer 14, a lower layer 36 and a hand opening 64. A single bag 70 is placed over the mitt 12, thereby providing the same functionally as the preferred embodiment. Once some waste material is grasped, the bag 70 is pulled off the mitt 12, and the bag 70 with the waste material therein is disposed of. The next time the WHGBU 10 is to be used, a person will manually put a new, replacement bag over the mitt 12.

While the invention has been described in detail and pictorially shown in the accompanying drawings it is not to be limited to such details, since many changes and modifications may be made to the invention without departing from the spirit and the scope thereof. For example, although a mitt 12 is preferably utilized, a glove having individual openings for each finger could also be effectively utilized. Hence, the invention is described to cover any and all modifications and forms which may come within the language and scope of the claims.

The invention claimed is:

1. A waste handling and bagging unit that is comprised of a mitt having an upper layer, a lower layer and a hand opening; and a plurality of nested bags that encompass said mitt and are attached to said mitt by a grommet assembly that is located adjacent to the hand opening on said mitt, wherein said waste handling and bagging unit allows a person to quickly, easily and hygienically grasp waste material, and to then enclose the waste material within one of the said bags for disposal, and wherein said nested bags allow a person to repeatably grasp and dispose multiple instances of waste material without having to manually put a new replacement bag on said mitt for each instance.

2. The waste handling and bagging unit as specified in claim 1 wherein said mitt is made of a biodegradable material that is selected from the group consisting of foam, corn plastic, paper, cotton and closed-cell foam.

3. The waste handling and bagging unit as specified in claim 1 wherein said mitt is made of a material that is selected from the group consisting of polyethylene, acrylic, PVC, polyester, rubber and nylon.

4. The waste handling and bagging unit as specified in claim 1 wherein said bag is made of a biodegradable material that is selected from the group consisting of corn plastic, paper, and cotton.

5. The waste handling and bagging unit as specified in claim 1 wherein said bag is made of a material that is selected from the group consisting of polyethylene, acrylic, PVC, polyester and nylon.

6. The waste handling and bagging unit as specified in claim 1 wherein the upper layer and lower layer of said mitt are attached together by an attachment means that is selected from the group consisting of an adhesive, heat pressing, stitching and stapling.

7. The waste handling and bagging unit as specified in claim 1 wherein said grommet assembly is comprised of an outer ring that is located on the outer surface of said upper layer, and an inner ring having an outer member that is located at the center of the outer ring, and a corresponding inner member that is located on the inner surface adjacent the rear edge of said mitt, wherein extending through the center of the outer ring, the outer member of the inner ring, the upper layer of said mitt, and the inner member of the inner ring is a bore, and wherein said nested waste bags are maintained on said mitt by placing a section of said bags adjacent the rear edge between the outer ring of said grommet assembly and the outer surface of said bag's upper layer.

8. A waste handling and bagging unit that is comprised of a mitt having an upper layer with an outer surface, an inner surface, a right edge, a left edge, a front edge, a rear edge, a left or a right thumb opening and a grommet opening; a lower layer with an outer surface, an inner surface, a right edge, a left edge, a front edge, a rear edge, a thumb opening and a grommet opening; and a plurality of nested waste bags that encompass said mitt, with each bag having an upper layer with an outer surface, an inner surface, a right edge, a left edge, a front edge and a rear edge; and a lower layer with an outer surface, an inner surface, a right edge, a left edge, a front edge and a rear edge; and an upper grommet assembly and a lower grommet assembly, with the upper grommet assembly located on the upper layer of said mitt adjacent to the rear edge, and the lower grommet assembly correspondingly located on the lower layer of said mitt adjacent to the rear edge, wherein said grommet assemblies maintain the plurality of nested waste bags over said mitt, wherein located at the rear edge of said mitt is a hand opening, and located at the rear edge of said bag is a corresponding opening, wherein said waste handling and bagging unit allows a person to quickly and easily grasp waste material, and then to enclose the waste material within one of the said bags for disposal, and wherein said nested bags allow a person to insert their hand through the two openings and into said mitt, repeatably grasp, bag, and dispose multiple instances of waste material without having to manually put a new replacement bag on said mitt for each instance.

9. The waste handling and bagging unit as specified in claim 8 wherein said mitt is made of a biodegradable material that is selected from the group consisting of foam, corn plastic, paper, cotton and closed-cell foam.

10. The waste handling and bagging unit as specified in claim 8 wherein said mitt is made of a material that is selected from the group consisting of polyethylene, acrylic, PVC, polyester, rubber and nylon.

11. The waste handling and bagging unit as specified in claim 8 wherein said bag is made of a biodegradable material that is selected from the group consisting of corn plastic, paper, and cotton.

12. The waste handling and bagging unit as specified in claim 8 wherein said bag is made of a material that is selected from the group consisting of polyethylene, acrylic, PVC, polyester and nylon.

13. The waste handling and bagging unit as specified in claim 8 wherein said mitt has a substantially rectangular shape.

14. The waste handling and bagging unit as specified in claim 8 wherein said mitt has a substantially rectangular shape with rounded corners.

15. The waste handling and bagging unit as specified in claim 8 wherein the upper layer and lower layer of said mitt are attached together by an attachment means that are selected from the group consisting of an adhesive, heat pressing, stitching and stapling.

16. The waste handling and bagging unit as specified in claim 8 wherein each said grommet assembly is comprised of an outer ring, an inner ring having an inner member and an outer member, and a bore that extends through the outer ring, the inner ring and said mitt, wherein the bore provides a convenient means of storing said waste handling and bagging unit on a wall hook or attaching said unit to an article of clothing.

17. The waste handling and bagging unit as specified in claim 8 wherein said plurality of nested waste bags are attached to said mitt by means of said upper and lower grommet assemblies.

18. The waste handling and bagging unit as specified in claim 8 further comprising a rigid member that is located across the front edge of said mitt, wherein the rigid member provides said waste handling and bagging mitt with a sufficiently strong front edge to perform scooping and shoveling actions.

19. The waste handling and bagging unit as specified in claim 8 wherein the lower layer of each said bag further comprising a textured outer surface, having calendering or a multiplicity of protrusions, wherein the textured surface allows improved grasping of the waste material.

20. The waste handling and bagging unit as specified in claim 8 wherein said mitt further comprising indicia on said upper layer outer surface or said lower layer outer surface.

21. The waste handling and bagging unit as specified in claim 8 wherein each said waste bag further comprising indicia on said upper layer outer surface or said lower layer outer surface.

* * * * *